United States Patent [19]

Chu

[11] 4,018,602

[45] Apr. 19, 1977

[54] METHOD FOR IN SITU FABRICATION OF PHOTOCONDUCTIVE COMPOSITE

[75] Inventor: Joseph Y. C. Chu, Fairport, N.Y.

[73] Assignee: Xerox Corporation, Stamford, Conn.

[22] Filed: Apr. 17, 1975

[21] Appl. No.: 569,131

[52] U.S. Cl. ..... 96/1.5; 252/500; 96/1.6

[51] Int. Cl.[2] ..... G03G 5/04

[58] Field of Search ..... 96/1.5, 1.6; 252/501, 252/500; 427/74

[56] References Cited

UNITED STATES PATENTS

| | | | |
|---|---|---|---|
| 3,287,115 | 11/1966 | Hoegl | 96/1.5 |
| 3,634,336 | 1/1972 | Perez-Albuerne | 252/500 |
| 3,814,600 | 6/1974 | Contois | 96/1.6 |

*Primary Examiner*—John D. Welsh
*Attorney, Agent, or Firm*—James J. Ralabate; James P. O'Sullivan; John H. Faro

[57] ABSTRACT

Method for in situ preparation of photoconductive composite having an electronically active hole transport layer, an electronically active electron transport layer and a layer of charge transfer complex sandwiched therebetween. According to this method, a film containing either an electron donor or an electron acceptor is initially formed directly on a supportive (preferably conductive) substrate. After this film has been allowed to set, a second film is solvent coated on the previously formed film. The solvent used in preparation of the second film causes softening of the previously formed layer which permits interaction of an electron acceptor or an electronic donor in the casting solvent with an electron acceptor or an electron donor of the previously formed layer, thereby forming a charge transfer complex at the interface of these two films. Only a portion of the donor and acceptor interact along this common boundary during the formation of the photoconductive composite. The balance of the noncomplexed donor and acceptor remain unperturbed in their respective layers, thus providing rapid and efficient transport of both species of charge carriers from within the bulk of the film upon photoactivation of the charge transfer complex.

5 Claims, No Drawings

METHOD FOR IN SITU FABRICATION OF PHOTOCONDUCTIVE COMPOSITE

BACKGROUND OF THE INVENTION

1. Field of the Invention

This invention relates to a method and the product produced by said method. More specifically, this invention is directed toward the preparation of a photoconductive composite having three distinct layers.

2. Description of the Prior Art

The formation and development of images on the imaging surfaces of photoconductive layers by electrostatic means is well known. The best known of the commercial processes, more commonly known as xerography, involves forming a latent electrostatic image on the imaging surface of an imaging member by first uniformly electrostatically charging the surface of the imaging layer in the dark and then exposing this electrostatically charged surface to a light and shadow image. The light-struck areas of the imaging layer are thus rendered relatively conductive and the electrostatic charge selectively dissipated in these irradiated areas. After the photoconductor is exposed, the latent electrostatic image on this image-bearing surface is rendered visible by development with a finely divided colored marking material, known in the art as "toner". This toner will be principally attracted to those areas on the image-bearing surface having a polarity of charge opposite to the polarity of charge on the toner particles.

The developed image can then be read or permanently affixed to the photoconductor where the image layer is not to be reused. This latter practice is usually followed with respect to the binder type photoconductive films (e.g. zinc oxide/insulating binder resins) where the photoconductive imaging layer is also an integral part of the finish copy, (U.S. Pat. Nos. 3,121,006 and 3,121,007).

In so called "plain paper" copying systems, the latent image can be developed on the imaging surface of a reusable photoconductor or transferred to another surface such as a sheet of paper and thereafter developed. When the latent image is developed on the imaging surface of a reusable photoconductor, it is subsequently transferred to another substrate and then permanently affixed thereto. Any one of a variety of well known techniques can be used to permanently affix the toner image to the copy sheet including overcoating with transparent films and solvent or thermal fusion of the toner particles to the supportive substrate.

In the above "plain paper" copying systems the photoconductive material used in the photoconductive insulating layer should preferably be capable of rapid switching from insulating to conductive to insulating state in order to permit the cyclic use of imaging surface. The failure of a material to return to its relatively insulating state prior to the succeeding charging/imaging sequence will result in an increase in the rate of dark decay of the photoconductor. This phenomenon, commonly referred to in the art as "fatigue", has in the past been avoided by the selection of photoconductive materials possessing rapid switching capacity. Typical of materials suitable for use in such a rapidly cycling imaging system include anthracene, sulfur, selenium and mixtures thereof (U.S. Pat. No. 2,297,691), selenium being preferred because of its superior photosensitivity.

In addition to anthracene, other organic photoconductive materials, most notably, poly(N-vinylcarbazole), have been the focus of increasing interest in electrophotography, U.S. Pat. No. 3,037,861. Until recently, neither of these organic materials have received serious consideration as an alternative to such inorganic photoconductors as selenium, due to fabrication difficulties and/or to the relative lack of speed and photosensitivity within the visible band of the electromagnetic spectrum. The recent discovery that high loadings of 2,4,7-trinitro-9-fluorenone in poly(vinylcarbazoles) dramatically improves the photoresponsiveness of these polymers has led to a resurgence in interest in organic photoconductive materials, (U.S. Pat. No. 3,484,237). Unfortunately, the inclusion of high loadings of such activators can and usually does result in phase separation of the various materials within such composition.

One of the alternatives to a totally organic system of the type described in the U.S. Pat. No. 3,484,237 referred to hereinabove is the fabrication of a photoreceptor wherein the light-absorbing species is distinct from the charge carrier transporting species, see, for example, U.K. Pat. No. 1,337,228, U.K. Pat. No. 1,343,671 and Can. Patent 932,199. In the systems described in the above references, charge carrier generation and charge carrier transport are performed by distinct chemical species of the imaging member (in both the (a) binder system [U.K. '671] and (b) layered systems [U.K. '228 ]). In these two latter references the electronic events of charge carrier generation and transport are performed by separate but contiguous layers. The relative order of these layers vis-a-vis one another is immaterial, however, in the preferred embodiments of the disclosed inventions, the light-absorbing, charge carrier generating layer is sandwiched between the conductive substrate and the charge transporting layer. The charge carrier transporting layer can comprise either a polymeric material or a nonpolymeric material. In the event that the nonpolymeric materials are selected, the use of such materials with a binder is generally preferred, if not required. This binder may be "electronically inert" (that is, incapable of substantial transport of at least one species of charge carrier) or can be "electronically active" (capable of substantial transport of at least one species of charge carrier). The use of such nonpolymeric materials in combination with a binder for the charge carrier transporting layer of such a device is beset with a number of problems. For example, where the binder is an electronically active polymer, such as N-vinylcarbazole, the oxidative stability of such material is rather short lived and thus, the electronic properties of the device will show a steady and progressive decline. In the event of selection of an electronically inert polymer as the binder, the resulting composition can at best be described as metastable and will also show a progressive decline in electronic properties. In this second binder system, such problems are related to the relative solubility of the nonpolymeric materials in the inert polymer and the relative stability of such solutions. Such instability is believed to be due at least in part to the tendency of nonpolymeric materials to migrate within the polymeric binder and thereby results in phase separation due to crystallization.

In light of the discussion immediately preceding, it appears that the problems inherent in such multi-layered photoconductors would preclude their use in copying systems requiring repeated cycling of the imaging member over an extended period of time since the electronic properties of the imaging member would not be capable of remaining within the machine specifications for such a device.

In addition, where such multilayered photoconductors are flexible, the continued flexing of the photoconductive composite can result in separation of the various layers from one another, thus destroying the electrical integrity and often the physical integrity of the imaging member. Accordingly, it is the object of this invention to remedy the above as well as related deficiencies in the prior art.

More specifically, it is the object of this invention to provide a method for preparation of a photoconductive composite wherein the various layers of said composite are substantially integral with one another.

It is another object of this invention to provide a method for preparation of a photoconductive composite having rapid and efficient transport of charge carriers of both polarity.

It is still yet another object of this invention to provide a method for preparation of a photoconductive composite in a manner so as to isolate the oxygen sensitive components of said composite from exposure to the environment.

Additional objects of this invention include the use of such photoconductive composites in electrophotographic devices and systems.

SUMMARY OF THE INVENTION

The above and related objects are achieved by providing a method for in situ preparation of a photoconductive composite comprising (a) initially forming an electronically active polymeric film on a supportive substrate, said polymeric film being capable of rapid and efficient transport of only one species of charge carrier due to the presence of either an electron donor or an electron acceptor within said polymeric film; (b) allowing said polymeric film to set; and (c) forming a second electronically active polymeric film on said previously formed polymeric film by solvent coating the components thereof directly on the surface of the previously formed polymeric film, the electronically active component of said second polymeric film being capable of rapid and efficient transport of the species of charge carrier not transported by said first polymeric film. Since the solvent used in coating the second film is also a solvent for the previously formed polymeric film, the electronically active materials of said second film are permitted to interact with the electronically active materials of the previously formed polymeric film whereby a charge transfer complex is formed as a result of interaction of the electronically active materials of the respective films at the interface of the two films. The resulting composite exhibits rapid and efficient transport of both species of charge carriers which are generated upon photoexcitation of this charge transfer complex.

DESCRIPTION OF THE INVENTION INCLUDING PREFERRED EMBODIMENTS

The substrates suitable for use in the method of the instant invention can include any supportive (preferably conductive) film. Materials which are especially useful as substrates include the materials traditionally employed in electrophotographic imaging members. In addition, any insulaing material can also be made suitable for use as a supportive substrate provided its insulating qualities can be modified by the inclusion of other materials which would permit the reduction in its resistivity so as to provide an appropriate ground plane for the other layers of the photoconductive composite of this invention.

As indicated above, the layer of the composite formed on the supportive substrate can contain either an electron donor or an electron acceptor. The method of formation of this layer on the conductive substrate is immaterial to the method of this invention provided that the film thus formed is coherent and adherent to the supportive substrate and the film itself (either the electron donor or electron acceptor material or the binder in which such materials are dispersed) is soluble, at least to some extent in the solvent used in formation of the second layer of the photoconductive composite. Typical of the materials suitable for use in this layer include any of the photoconductive polymers such as poly(N-vinylcarbazole), poly(3-vinylcarbazole), poly(2-vinylcarbazole), poly(2-vinylanthracene), poly(vinylpyrene) and poly(vinylindole). Alternatively, nonpolymeric materials may also be used in formation of this initial layer by dissolving and/or dispersing said materials in a suitable nonphotoconductive binder. Representative of such nonpolymeric materials include carbazole, pyrene, julolidine, anthracene, fluorenone, 2,4,7-trinitro-9-fluorenone, oxadiazole and BIS-(4-di-enthyl-amino-2-methylphenyl) phenylmethane. In the event that such a nonpolymeric material is selected, it is generally preferred, if not required, that such nonpolymeric materials be used in conjunction with a suitable polymeric binder. Representative binders which can be employed in combination with such nonpolymeric materials include polycarbonates, polyesters, phenolic resins, polyolefins (e.g. polyethylene, polypropylene), silicone elastomers, melamine, phenoxy, epoxy and acrylic resins. It is generally preferred that the relative concentration of electronically active materials to polymeric binder should not be sufficient to cause phase separation of these materials in the transport layer. Good transport layers are obtained wherein the concentration of electronically active materials to binder is in the range of from about 25:75 to about 75:25; about 50:50 being preferred. In the event that some phase separation of materials does occur, the phase separated layer should be located contiguous with the conductive substrate so as to not adversely effect image resolution.

After this initial film of the photoconductive composite is formed, it is allowed to set. Setting of such films generally involves permitting sufficient time to elapse for the materials in such film to form a coherent and electronically acceptable layer. Where the film is formed by coating a melt of these materials on a supportive substrate, the film is allowed to cool until it is no longer tacky. Where the film is formed by solvent coating or casting techniques, the film is allowed to set in a manner so to insure that it is substantially devoid of solvent residues prior to the application of the second layer. Premature application of a second coating on an unset film can result in trapping of such residues within the bulk of the layer and thereby cause disruption in the electronic performance of this layer.

Any one of a combination of materials disclosed as suitable in preparation of the initial film of this photoconductive composite can be used in preparation of the outermost film of the photoconductive composite provided that the electronically active materials of said second film are capable of formation of a charge transfer complex with the electronically active materials of the previously formed film. In addition, such second layer must be capable of solvent coating, and the solvent used in formation of this second layer must also be capable of partially softening the previously formed layer so as to permit interaction of the electronically active materials contained in each layer. Since it is generally known that electronically active donor materials are susceptible to oxidation upon exposure to the ambient environment and the ozone generated during corona sensitization of such materials, it is generally preferred that the layer containing the electron donor be formed contiguous with the conductive substrate and the layer containing the electron acceptor be formed over the electron donor layer. Apparently, electron acceptor materials are not appreciably sensitive to oxidation and thus the photoconductive composite will remain more electronically stable in the above configuration. The thickness of the layer contiguous with the conductive substrate will to some extent be controlled by the thickness of the outermost layer of composite and the relative affinity of the materials in such layer relative to the solvent used in coating the second layer of the photoconductive composite. Such initially formed layer should be sufficiently thick so as not to be completely dissolved by such solvent. In addition, the combined thickness of the various layers of the photoconductive composite must be sufficient to sustain the sensitizing charge impressed upon such composite during electrophotographic imaging. Accordingly, the combined thickness of the photoconductive composite can range from about 10 to about 300 microns. In the preferred embodiments of this invention the outermost layer of the photoconductive composite should generally be thicker than the inner layer of the photoconductive composite in order to accommodate some erosion thereof during repeated cleaning in the electrophotographic imaging process. The relative thickness of the individual transport layer is also preferably controlled so as to insure that the transit times of carriers through each layer is as closely matched as possible. One method for adjusting the relative transit times of carriers through a layer (other than altering of the concentration of electronically active materials in the layer) involves the use of mixtures of different electronically active materials. For example, the transit times of holes through a layer of poly(N-vinylcarbazole) can be reduced by the addition of bis(4-diethyl-amino-2-methylphenyl) phenylmethane to the transport polymer.

As indicated above, the thickness of the layer of the photoconductive composite contiguous with the conductive substrate should be sufficient so as to not totally dissolve said layer during formation of the second layer of the composite thereon. The extent to which such first layer is softened by the solvent used in formation of the second layer need not be extensive. It is sufficient that the solvent used in formation of the second layer merely cause some softening or swelling of the previously formed layer so as to permit diffusion of the electron donor or electron acceptor materials from the coating slurry to impregnate the first layer and thereby form a charge transfer complex with the electronically active materials contained in said first layer. Insofar as the materials used in the formation of both transport layers of the photoconductive composite are substantially colorless, the competition for absorption for incident radiation directed upon said imaging member during imaging is not great and thus the intensity of charge transfer interaction need only be sufficient to form a colored layer capable of substantial absorption of such imaging energies. Of course, the greater intensity in charge transfer complex formation, the more complete absorption of such energies. Sufficient charge transfer interaction must occur to produce the charge transfer complex having an optical density of greater than about 0.3 and preferably greater than about 1. It is, however, both critical and essential that the predominant region of charge transfer complex formation be isolated at the interface of these two layers. This is necessary in order to avoid the problems inherent in bulk generation of charge carriers. By isolation of the charge transfer complex at the interface of a hole transport and an electron transport layer, essentially complete photodischarge of the imaging member is possible without substantial trapping of either species of charge carrier within the layer upon photoexcitation of said charge transfer complex. In order to insure such a result, it is highly desirable to control the diffusion of materials from said second layer into said first layer in order to preclude creation of a zone of charge transfer complex thicker than about 2 and preferably less than 1 micron.

The Examples, which follow, further define, describe and illustrate the method of this invention. Apparatus and techniques used in preparation and evaluation of the electrophotographic composites prepared according to this method are standard or as hereinbefore described. Parts and percentages appearing in such Examples are by weight unless otherwise stipulated.

EXAMPLE I

An organic hole transport layer is formed on a ball-grained aluminum plate 2 inches wide by doctor blade coating a 3 weight percent solution of poly(N-vinylcarbazole) from chloroform. The apparatus used in such coating procedure is a Gardener mechanical drive apparatus wherein the doctor blade has a wet gap setting of 6 mils. The coated plate is allowed to dry in a hood overnight and then placed in a vacuum oven at 60° C for 14 hours in order to insure substantially complete evaporation of solvent residues. After this hole transport layer has satisfactorily set up, a second layer of organic electron transport material is coated thereon from a tetrahydrofuran solution containing 23 weight percent of equal parts 2,4,7-trinitro-9-fluorenone and Mylar 49000 (polyethylene terephthalate). Almost immediately upon coating of the second solution on the hole transport layer a highly colored charge transfer complex is formed at the interface of these two films. The second layer is dried in the same manner as described for drying of the first layer. The plate is then imaged by standard electrophotographic techniques using a Xerox Model D Processor. The plate is initially charged to a positive potential of 600 volts followed by contact exposure to white light through a resolution target. The latent electrostatic image thereby formed on the surface of the photoconductive composite is developed with Xerox 2400 Toner on 250 micron steel MTP carrier. The image thus produced has excellent resolution and can be readily transferred to a positively charged piece of untreated paper. Any toner residues remaining on the surface of the photoconductive composite are removed by physically wiping the surface of said composite with a cotton pad. The imaging process described above is repeated and the results equivalent to those initially obtained.

EXAMPLE II

The procedures of Example I are repeated except for reversal in the order of formation of the individual layers of the photoconductive composite on the supportive substrate. The plate thus produced is imaged in the manner described above except that the polarity of the sensitizing charge is now negative.

The long range stability of the plate prepared according to this Example is inferior to the long range stability of the plate prepared according to Example I. Progressive deterioration in the electrical properties of the plate of this Example is believed due in part to the progressive oxidation of the poly(N-vinylcarbazole) upon repeated exposure to the ozone produced during sensitization.

It is, therefore, preferred that the electron donor layer be formed contiguous with the conductive substrate in order to prolong the useful life of the photoconductive composite. It is also preferred that the electron acceptor materials used in formation of the outermost layer of the photoconductive composite be nonpolymeric in order to insure greater mobility of such electron acceptor materials in the coating solution and thus the more rapid and uniform penetration of such materials into the previously formed electron donor layer.

EXAMPLES II – VIII

The procedures of Example I are repeated except for the substitution of the following nonpolymeric hole transport materials for poly(N-vinylcarbazole). The resinous binder used in combination with such nonpolymeric materials is the same as used for the electron transport layer of Example I. The weight ratio of hole transport material to polymeric binder in this hole transport layer is 1:1.

| Example No. | Hole Transport Material |
|---|---|
| III | bis(4-di-ethyl-amino-2-methyl-phenyl) phenylmethane |
| IV | juloidine |
| V | bis-2,5-(p-diethylaminophenyl)-1,3,4-oxadiazole |
| VI | pyrene |
| VII | anthracene |
| VIII | perylene |

EXAMPLES IX – XIII

The procedures of Example II are repeated except for the substitution of the following nonpolymeric electronically active electron transport materials for 2,4,7-trinitro-9-fluorenone.

| Example No. | Electron Transport Material |
|---|---|
| IX | tetracyanoquinodimethane |
| X | 2,4,5,7-tetranitro-9-fluorenone |
| XI | 2,5,7-trinitro-4-iodo-9-fluorenone |
| XII | 2,5,7-trinitro-4-bromo-9-fluorenone |
| XIII | 9-dicyanomethylene-2,4,7-trinitro-fluorene |

In the event of excessive crystallization of the nonpolymeric electronically active material in the binder resin, the relative arrangement of the electronically active layers via-a-vis the substrate should be reversed.

What is claimed is:

1. A method for in situ preparation of a photoconductive composite comprising:

a initially forming an electronically active polymeric film on a supportive substrate, said polymeric film being substantially non-photoresponsive to visible light and capable of rapid and efficient transport of only one species of charge carrier due to the presence of either an electron donor or an electron acceptor within said polymeric film;

b allowing said polymeric film to set; and c forming a second electronically active polymeric film on said previously formed polymeric film by solvent coating the components thereof directly on the surface of the previously formed polymeric film, the electronically active component of said second polymeric film being substantially non-photoresponsive to visible light and capable of rapid and efficient transport of the species of charge carrier not transported by the previously formed polymeric film, whereupon the solvent of the coating solution causes sufficient softening of the previously formed film thereby permitting charge transfer interaction of the electronically active components of each layer with the electronically active components of the other layer, the extent of such charge transfer interaction being sufficient to enable formation of a charge transfer complex having an optical density of greater than about 0.3 and yet insufficient to create a charge transfer complex zone thicker than about 2 microns.

2. The method of claim 1 wherein the polymeric film formed on the supportive substrate is capable of rapid and efficient transport of holes.

3. The method of claim 1 wherein the polymeric film formed on the supportive substrate is capable of rapid and efficient transport of electrons.

4. The method of claim 1 wherein the polymeric film formed on the supportive substrate comprises a photoconductive polymer which is substantially incapable of photoresponse within the visible region of the electromagnetic spectrum.

5. The method of claim 1 wherein the second electronically active polymeric layer comprises a nonpolymeric, electronically active component dissolved and/or dispersed in a resinous binder.

* * * * *